US006247358B1

(12) United States Patent
dos Santos

(10) Patent No.: US 6,247,358 B1
(45) Date of Patent: Jun. 19, 2001

(54) METHOD FOR THE EVALUATION OF SHALE REACTIVITY

(75) Inventor: Hélio Maurício Ribeiro dos Santos, Rio de Janeiro (BR)

(73) Assignee: Petroleo Brasilleiro S.A. Petrobas, Rio de Janeiro (BR)

( * ) Notice: Subject to any disclaimer, the term of this patent is extended or adjusted under 35 U.S.C. 154(b) by 0 days.

(21) Appl. No.: 09/084,602

(22) Filed: May 27, 1998

(51) Int. Cl.[7] ..... G01N 15/08; E21B 49/02; E21B 49/00; G01V 3/06; C09K 7/02

(52) U.S. Cl. ..... 73/152.11; 73/152.07; 73/795; 73/798; 166/282; 175/64

(58) Field of Search ..... 73/152.11, 38, 73/152.07, 152.09, 795, 789, 807, 798; 175/50, 64; 166/279, 250.02, 282, 270

(56) References Cited

U.S. PATENT DOCUMENTS

| | | | | |
|---|---|---|---|---|
| 3,702,564 | * | 11/1972 | Chenevert | 73/73 |
| 4,359,901 | * | 11/1982 | Bates et al. | 73/153 |
| 4,790,180 | * | 12/1988 | Sinnokrot | 73/153 |
| 4,799,382 | * | 1/1989 | Sprunt et al. | 73/153 |
| 4,852,400 | * | 8/1989 | Wingrave | 73/153 |
| 4,876,512 | * | 10/1989 | Kroeger et al. | 324/376 |
| 4,982,604 | * | 1/1991 | Davis et al. | 73/153 |
| 5,036,915 | * | 8/1991 | Wyganowski | 166/252 |
| 5,205,164 | * | 4/1993 | Steiger et al. | 73/153 |
| 5,253,518 | | 10/1993 | Steiger et al. | 73/153 |
| 5,275,063 | | 1/1994 | Steiger et al. | 73/864.6 |
| 5,325,723 | * | 7/1994 | Meadows et al. | 73/794 |
| 5,670,717 | * | 9/1997 | Lamine | 73/152.11 |
| 5,710,107 | * | 1/1998 | Walker | 507/110 |
| 5,925,598 | * | 7/1999 | Mody | 507/140 |

OTHER PUBLICATIONS

SPE 18024 "Quantitative Determination of the Mechanical Properties of Shale" by R.P. Steiger and P.K. Leung, Exxon Production Research CO. SPE Member. pp. 69–75, Oct. 1988.

"Shale Reactivity Test: A Novel Approach to Evaluation Shale–Fluid Interaction" Int. J. Rock Mech. & Min. Sci. vol. 34, No. 3–4, 1997 ISSN 0148–9062, Jun. 1997; by Authors Santos, H., Diek, A., deFontoura, S. and Roegiers, J–C.

* cited by examiner

*Primary Examiner*—Hezron Williams
*Assistant Examiner*—David J. Wiggins
(74) *Attorney, Agent, or Firm*—Sughrue, Mion, Zinn, Macpeak & Seas, PLLC

(57) ABSTRACT

Shale reactivity is evaluated by testing a preserved test plug of shale sample in a triaxial test machine, the test plug being prepared by collecting a downhole shale sample and keeping it all times immersed in a preserving mineral oil so as to avoid dehydration, then applying radial and axial pressure on the test plug surrounded by mineral oil up to equilibration to overburden pressure, the test fluid being then contacted with the sample and the interaction of fluid and sample being evaluated by axial and radial deformations as measured by a triaxial detector apparatus sensitive to vertical and radial strains occurring across the shale sample, while the shale sample is subjected to any of a set of different conditions including a temperature or thermal potential, a hydraulic potential and/or a chemical potential. Only one fluid is tested on each sample. A sister test at ambient temperature and atmospheric pressure is run in order to constitute a visual counterpart of what is occurring in the triaxial test machine.

10 Claims, 3 Drawing Sheets

METHOD FOR THE EVALUATION OF SHALE REACTIVITY

FIELD OF THE INVENTION

The present invention relates to a method for the evaluation of the reactivity of clay-rich materials such as shales as expressed by the interaction of fluids and such geologic materials, that interaction being measured by axial and radial deformations of a plug of shale under constant pressure.

BACKGROUND INFORMATION

Borehole instability in clay-rich rocks such as shaly sandstones, mudstones and shales is regarded as the prime technical problem area in oil and gas well drilling, being one of the largest single source of trouble time associated with drilling.

Not only the high cost, but also environmental requirements are forcing the industry to replace oil-based muds by more benign, water-based drilling fluids. Especially, high-cost/high-risk operations are in need of superior drilling fluids and optimised borehole stabilizing practices.

According to Ronald P. Steiger and P. K. Leung in "Quantitative Determination of the Mechanical Properties of Shales", SPE paper n° 18024, Houston, Tex., Oct. 2–5, 1988, shales are best defined as fine grained sedimentary rocks that contain significant amounts of clay minerals. The term "shale" is normally used to describe extremely low permeability, clay-bearing rocks ranging from illitic siltstones to smectitic mudstones. These rocks contain hydratable clays that make them water sensitive, i.e., cause them to take up water and swell. Uncontrolled hydration or drying can cause rapid deterioration of the rock structure making it very difficult to obtain or maintain sample integrity. Shales have complex, ill-defined compositions and extremely low permeabilities to water that are in the microdarcy to nanodarcy range. The authors allege that the results obtained from the shale tests greatly improve the predictive capabilities of wellbore stability models.

Several mechanisms govern water (fluid) movement in or out of the shale. The two most relevant mechanisms are the hydraulic pressure difference, $\Delta p$, between the wellbore pressure (mud weight) and the shale pore fluid pressure, and the chemical potential difference, $\Delta\mu$, between the drilling and shale pore fluids.

The macroscopic expansion of shale samples contacted by water takes place even when the brine contacting the sample is under no pressure which eliminates the pressure difference between the brine and the pore fluid as a driving mechanism for the water movement. It was then hypothesized that this movement was due to osmosis. Water uptake thus happens because the shale-fluid system acts as a semi-permeable membrane which only allows the movement of water. In the case of an oil-based fluid, this membrane is assumed to be ideal. This water movement is driven by the difference of the activity of the water in the shale, usually referred to as the shale activity ($a_{sh}$) and that of the mud ($a_m$). A movement of water is thus initiated either from the mud to the shale when $a_{sh}<a_m$ or from the shale to the mud when $a_m<a_{sh}$. The water intake by the shale usually corresponds to its expansion which, when blocked,—i.e.—isochoric conditions—causes the development of compressive swelling stresses. On the contrary water loss corresponds to shrinkage of the shale or to the development of tensile stresses under isochoric conditions. Under zero volume variations and for equal fluid pressures in the shale and in the mud, the swelling stress is equal to $$\Delta\Pi=(RT/V)\mathrm{Log}(a_{sh}/a_m)$$

where V is the molar volume of water, R the constant of ideal gases and T the absolute temperature. The theories developed to quantify the mechanical consequences of such activity variations are based on the above principle.

One way to validate the osmotic theory is by direct measurements of true swelling stresses on shales contacted by various fluids. Tests were performed on Pierre shale samples conditioned at different activities between 0.92 and 0.98 and contacted with various aqueous fluids such as de-ionized water, NaCl, $MgCl_2$, $CaCl_2$ and glycerol based fluids—under the same initial stresses and pressures. The confining pressure increase required to suppress the expansion of the specimens was measured so as to obtain a direct measurement of the swelling stress in the specimens.

The effect of the drilling fluid on shales is evaluated according to various techniques, from very simple to more sophisticated ones. Tests under atmospheric pressure employ immersion of the shale sample in a certain solution. The rock reactivity can be evaluated by different means: sample weight loss, rock surface hardness index, and sometimes only visual and tactile inspection. The most striking limitation of this kind of test is the lack of confining pressure. However, the simplicity of these immersion tests leads the industry to still use them in selecting drilling fluids. Outcrop shale samples and/or dried cores are used, along with reconstituted samples obtained by grinding the original shale, adding water and confining it. On using partially-dried or outcrop samples, a strong swelling is usually observed when the shale is exposed to fresh water.

In the swelling pressure test the rock is subject to confining and pore pressure, so as to simulate downhole conditions. After applying the initial confining pressure to the rock, the sample is exposed to a test fluid. If the rock reacts with this fluid, it will usually swell, expanding its volume. As the test is conducted under constant volume, pressure variation from the initial condition is called the swelling pressure of that rock when exposed to such a fluid. The stronger the reaction, the bigger the swelling pressure. In the well-known methods developed and patented by Ronald P. Steiger, a setup and procedure are presented with results from swelling pressure tests. The tests consist in circulating the test fluid around the sample under a constant fluid pressure. This way, the rock is subject not only to a chemical potential but also to a hydraulic potential. Shale samples are adjusted under equilibrium conditions to predetermined standard water contents and activities.

Thus, U.S. Pat. No. 5,253,518 teaches methods for multistage tests of material samples, including but not limited to rock and shale samples, the methods, in one aspect, including the steps of placing a load on the sample, while under a constant confining pressure the sample mounted in a triaxial test apparatus; measuring and recording sample pore pressure continuously during the test; removing the load on the sample; changing confining pressure on the sample; permitting the sample's pore pressure to equilibrate at a new pore pressure with the new confining pressure; permitting the sample to drain fluid to an equilibrium value and placing a new load on the sample measuring and recording resulting pressure and load.

U.S. Pat. No. 5,275,063 teaches methods and apparatuses for testing the effects of one or more fluids on geologic materials; in one aspect a method for quantitatively determining the hydration and swelling behavior of shale core samples in response to one or to different fluids circulated around a core sample confined under pressure in a test cell; apparatuses for circulating such fluids and for conducting such tests; and an adjustable LVDT (linear voltage differential transducer) holder.

According to U.S. Pat. No. 5,275,063 the test apparatus for measuring the effects of fluids on preserved samples of geologic material comprises a test cell in which the sample can be subjected to pressure in three dimensions, means for circulating a first test fluid around the entire outer surface of the sample, the sample changing dimensionally in three dimensions in response to the first test fluid, means for controlling dimensional change of the sample, and means for measuring dimensional change of the sample in response to the first test fluid.

The work which grounded the experiments reported in U.S. Pat. Nos. 5,253,518 and 5,275,063 relies on the assumption that shales, being formations with high clay contents, are thus subject to hydration, swelling and reduction in compressive strength upon exposure to water. Further, the authors of these U.S. patents consider that confined shales upon exposure to low salinity water can develop very high swelling pressures. Thus, inhibitive drilling fluids are often required to prevent wellbore destabilization due to shale hydration. These patents aim at determining the swelling pressure generated by a shale in the borehole wall upon exposure to a fluid, this having a great impact on the relative weakening of the shale and possible wellbore failure. It is alleged that quantitative swelling pressures of preserved shales have not been measured in prior work and that quantitative evaluation of the effects of fluids on geologic materials, e.g. the effects of different chemicals such as inhibitive drilling fluids on low permeability rock such as shale is disclosed in U.S. Pat. No. 5,275,063.

In spite of the thorough studies disclosed in the above U.S. patents, since experiments are run under the $\Delta V=0$ condition, the axial and radial deformations together (swelling) caused in the shale by the reaction with water or any other reacting fluid are registered as the final figure resulting from axial and radial pressures applied to the shale sample. Ideally, it would be interesting to separately determine the swelling pressure in each direction, the axial and the radial direction, and not just the swelling pressure resulting from the interaction of the swelling in both directions. radial direction, and not just the swelling pressure resulting from the interaction of the swelling in both directions.

Further, the meaning of "preserved shale" or "preserved rock" in the U.S. patents cited above is different from the one used by the Applicant. In the above U.S. patents, "preserved shale" means a shale sample which, in spite of having been preserved in mineral oil for some time before the swelling pressure test, is left exposed to air for as long as a few hours before the effective measurement of the swelling pressure. Besides additional factors, this causes severe water loss in the shale sample, which when in contact with the test fluid tends to absorb it, and consequently swell. Therefore the shale under test is not truly preserved since it has been exposed to air and it has effectively dehydrated. It should be emphasized and it will be thoroughly discussed below the importance of preserving the integrity of the shale sample in an inert, organic fluid such as mineral oil at all times before exposing the sample to the test fluid, so as to avoid water loss which severely imparts the original rock reactivity and alters measurements.

Therefore, the state-of-the-art technique directed to the quantitative determination of the hydration behavior as expressed by swelling stress and swelling pressure of shales lacks accuracy in the sense that the methods and apparatuses make measurements on shale samples which are dehydrated and therefore do not represent the shale rock as it exists in the formation. Therefore, all observations and measurements effected under the wrong preservation conditions leading to dehydration of the shale sample and consequently to gross errors in measurements, should be thoroughly reviewed.

It seems clear then that the state-of-the-art technique focuses on a swelling process which does not convey the actual phenomena occurring when drilling fluids contact clay-rich rocks such as shales under confining pressures. That is why the present invention focuses instead on the reactivity of a truly preserved sample of clay-rich rock in contact with a drilling fluid.

Thus, in order to remediate the lack of accuracy of the presently published data, the Applicant teaches now a method for making measurements of shale reactivity where the water content of the shale test sample has been maintained very close to the in situ or downhole condition and therefore the test samples can be considered as truly preserved.

SUMMARY OF THE INVENTION

The present invention is directed to a method for determining the shale reactivity under constant pressure with the aid of a triaxial test, the water content of the samples being as close as possible to the in situ, downhole water content of the shale as existing in the formation.

In general terms, the very concept of the present application focuses on the preservation of the downhole water content of the shale sample. In the present application the expression "preservation of the original water content of the shale sample" means that the shale sample, since its collection in the formation, preparation for the triaxial test and triaxial test is not exposed to air for more than 5 minutes, being otherwise kept from dehydration by being surrounded by mineral oil. This is achieved through a coring procedure which involves immersion of the shale samples in oil when cutting the cylindrical plugs or cores for triaxial tests, thus avoiding any contact of the shale sample with air which ultimately keeps the sample free from dehydration. The assembly used in coring comprises the coring machine, the pumping system and the shale coring box, this latter being filled with mineral oil. The whole procedure is conducted with the sample immersed in mineral oil.

The thus obtained sample is kept under mineral oil and tested in a triaxial test apparatus according to the state-of-the-art technique.

The test procedure was grounded on the restriction that the sample should not be exposed to air for more than 5 minutes. Thus, immediately after placing the sample inside the rubber sleeve and permeable membrane which are part of the test apparatus, oil should be pumped through the pore pressure system surrounding the sample.

The confining pressure is applied to the sample in a monotonic sequence of pressure changing steps. As a consequence, an excess pore pressure is created. The sample is then allowed to equilibrate by drainage of the pore water leading the rock to contract. When the rock no longer contracts, it attains equilibrium and the confining pressure can be further increased until the test pressure be achieved. Depending on the pressure level adopted and the rock characteristics, several days may be required until the rock consolidates and equilibrates the pore pressure. It is important to emphasize that during this quiescent time period the sample's humidity is being preserved by the mineral oil surrounding it. At this point the test fluid is circulated around the sample. The pressure of the test fluid may be the atmospheric pressure. The temperature of the test fluid may be the ambient temperature. The test fluid displaces the mineral oil which surrounds the sample, fills the rock pores and contacts the rock (shale sample). The rock reactivity can be, then, evaluated by the radial and axial deformations recorded.

It should be emphasized that the equilibration period may take several days, and that during all this period the shale sample is surrounded by mineral oil and therefore all water loss is avoided. Since the state-of-the-art technique does not contemplate the practice of surrounding the sample with mineral oil, it is understandable that a sample not protected from water loss will indeed dehydrate before the actual contact with the test fluid, in such a manner that the obtained results will be jeopardized.

The triaxial test apparatus is connected to a personal computer which is responsible for all the data acquisition. Pressures and deformations are automatically recorded and the equipment adjusts and maintains the applied pressures with great accuracy. The resulting axial and radial deformations can be followed during and after the test by printed graphs. The obtained graphs are then interpreted in the light of the principles discussed below.

The present invention is therefore directed to a method for the evaluation of shale reactivity which comprises the steps of:

collecting shale cores and preparing test plugs for testing under conditions of original downhole hydration;

under the same conditions of original downhole hydration, introducing test plug in a triaxial test machine for triaxial test and raising confining pressure in axial and radial directions by increments of from 500 to 1,000 psi, while equilibrating the sample after each increment in pressure, the pressure being raised up to the overburden pressure experienced by the collected shale in the reservoir;

by draining, allowing the pore pressure to equilibrate between each increment in confining pressure, while still preserving conditions of original downhole hydration by circulating mineral oil through the pore pressure system, the equilibrium being monitored by both radial and vertical strains;

after equilibrium is attained, introducing the test fluid in the pore-pressure system so as to test the interaction of the test fluid and the test plug by displacing the mineral oil, and monitoring reactions of test plug and test fluid by means of deformation measurements, while keeping confining pressure constant.

It should be noticed that for the sake of comparison and as a visual counterpart of the triaxial test run in the interior of the triaxial test machine, a piece of the outer shell of the drilled core from which the sample for the triaxial test has been retrieved is placed in the same test fluid as that used in the test machine. This is a manner to visually follow what is being held in the interior of the triaxial test machine.

The present invention thus provides a method for the highly accurate measurement of the interaction between fluids and a clay-rich rock such as a shale, the accuracy of the measurement being derived from it being effected on a shale sample whose water content is very close to the in-situ, downhole water content of the shale in the reservoir.

The present invention provides also a method to quantify the fluid-rock interaction by means of deformations in the radial as well as in the axial direction, both deformations being individually observed. Since a shale is a highly anisotropic laminated rock, it is important to separate the effects on the axial and radial directions. The measurement of deformations provide a quantitative evaluation of the reaction of the rock or shale sample with the fluid. Increase in length represents swelling, whereas a decrease in the same quantity means that the rock is contracting. The so-called swelling behavior of shales can, therefore, be quantified by the difference between the final and initial lengths in each direction, this difference being obtained by comparing the final and initial volume of the shale sample.

The present invention provides also a method where the measurement of the interaction between fluids and a shale sample may be done by submitting such sample to different conditions, such as temperature, hydraulic potential, and chemical potential, in order to closely mimic the downhole conditions. The results herein presented are limited to demonstrating the effect of the chemical potential on the shale sample.

Data on the influence of hydraulic potential may be obtained by imposing a hydraulic potential through carrying out the test fluid under pressure, different from atmospheric pressure.

If desired, downhole temperature can be reproduced by running the test at higher than laboratory, ambient temperature.

BRIEF DESCRIPTION THE DRAWINGS

FIG. 1 is a schematic view of the setup for the triaxial test according to the present invention. The mineral oil is flown around the test plug of shale sample immediately after placing the test plug on the base, to secure adequate preservation of the shale sample. In this Figure the devices to measure the radial and axial deformations are not shown.

FIG. 2 is a graph of the circumferential length variation for an aluminum test plug submitted to the triaxial test according to the method of the present invention. This test was conducted to evaluate the deformations and interactions of the permeable sleeve and rubber sleeve with the mineral oil and water. As expected, no deformation was recorded after the aluminum sample was exposed to water.

Figure 5:
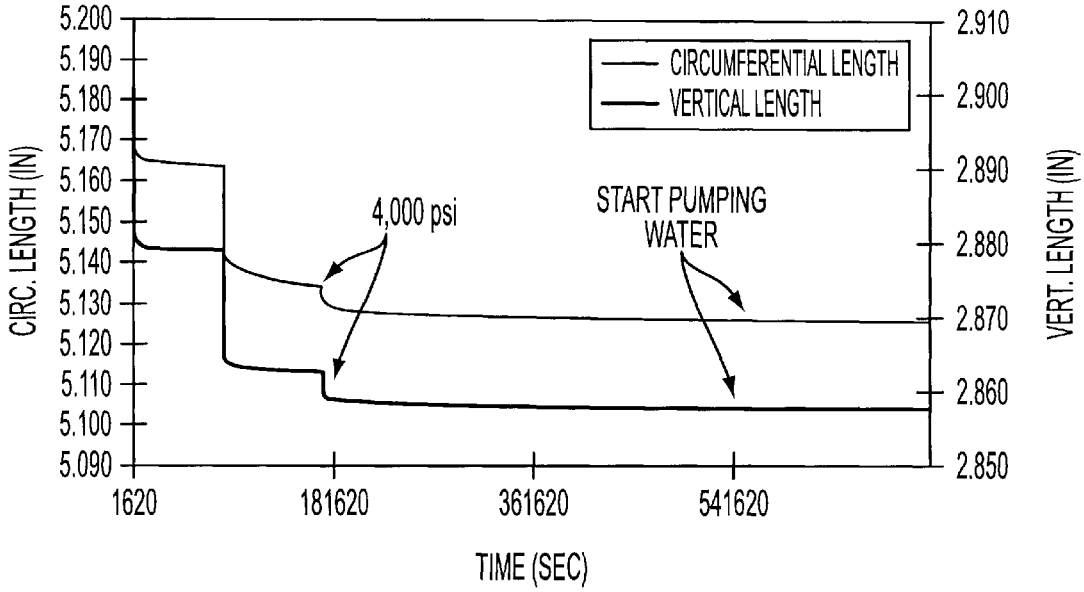

FIG. 5 is a graph of the circumferential and axial length variation for a test plug of preserved shale according to the present invention. As can be seen, after water has contacted the sample no deformation is detected, indicating absence of reaction. The test fluid here was de-ionized water, chosen to create the worst scenario in terms of chemical potential.

Figure 6:
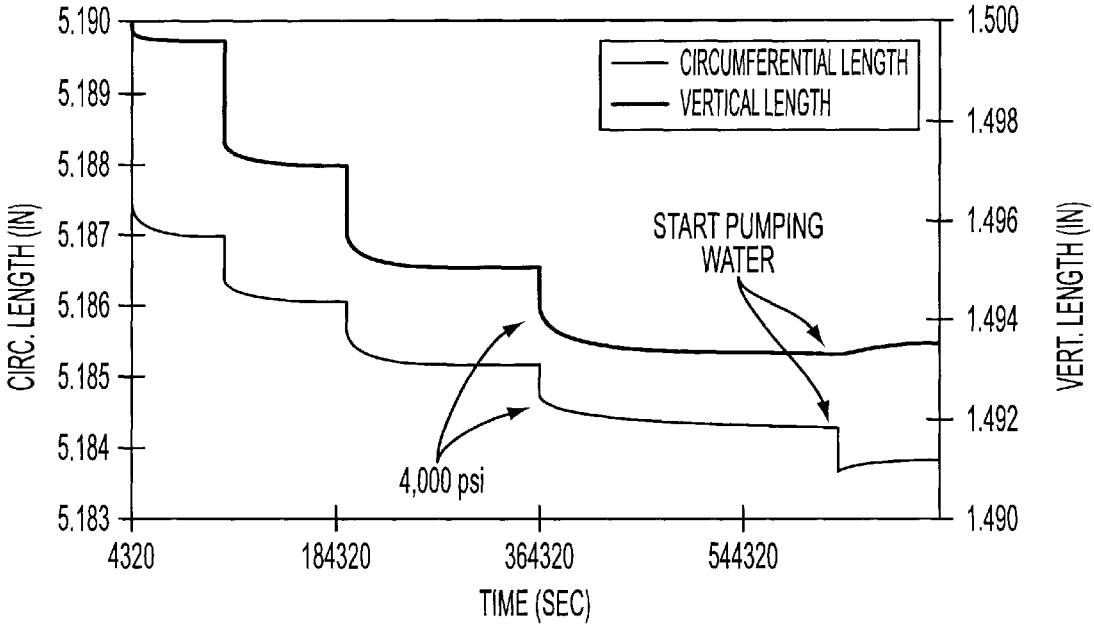

FIG. 6 is a graph of the circumferential and axial length variation for an 8-hour air-dried shale. The test plugs used in the tests depicted on FIG. 5 and FIG. 6 were taken from the same shale so as to show the influence of air-drying on shale reactivity. On the air-dried shale, strong reaction can be seen when water contacted the sample. In the axial direction, expansion is detected, whereas in the circumferential direction a contraction is recorded. This contraction is due to the outer layer, mechanically damaged by the coring process, that reacted with water and was removed.

PREFERRED MODE

As stated hereinbefore, the outstanding accuracy of the method of the present application relies on the preservation of the in situ, downhole water content of the shale sample.

In order that the phenomena undergone by a test plug of shaly rock which is submitted to interaction with an aqueous fluid, for example during a triaxial test, be understood, a few concepts should be made clear.

It is well-known that shales are fine-grained detrital sedimentary rocks which contain variable amounts of clay and accessory minerals such as quartz, carbonates and feldspars forming a complex structure with a variable pore size distribution. Water distribution within such a system is another important variable in examining shale reactivity. In addition, it is important to separate shale water as free water and bound water.

The free water is considered as filling macropores (>10 $\mu$m) between clay aggregates and/or particles of accessory minerals as well as interparticle pores of the order of microns between clay particles within aggregates. Free water may be eliminated from the sample by heating to about 105° C. up to constant weight.

The state-of-the-art technique for determining water content in shales makes use of this concept. Thus samples are heated of from 65 to 105° C. until weight stabilization. The difference in weight before and after drying is attributed to water loss. Further, crushed and pressed samples are used to facilitate water loss.

However, as discussed in detail in co-pending application by the same inventor "A Method for Evaluating Drilling Fluids", the idea that free water is released by heating to 105° C. should be reviewed since the interlayer water in smectite is released below 100° C. Therefore the temperature ranges where the different kinds of water are released are objectionable.

As for bound water, since it occupies interlayer spacing within expandable clay particles, it requires a higher energy to be removed than does free water. Water molecules are confined to two-dimensional structures, or layers present in integral numbers as a function of relative humidity, i.e., the activity of water ($A_w$). It is considered that the most energetically bound water is associated with the exchangeable cations. Bound water requires in general temperatures above 200° C. to be removed.

In addition, crystalline water or structural hydroxyls contained in the unit layer perhaps play the role of anion-exchange sites. The hydroxyl groups combine to form water on heating to about 550° C.

The balance between bound water and free water depends on the nature of the particular clay as well as on the nature of the cations. Thus, in smectite, sodium and magnesium enhance bound water, while calcium and potassium enhance free water. Temperature and salinity decrease the amount of bound water. Since bound water molecules are not completely immobilized, they may be exchanged with free water.

Another point is the effect of mechanical work on a shaly sample. Thus, a thin powder is generated on a saw cut surface when a preserved sample is immersed in de-ionized water, whereas on a pre-existing surface where no mechanical work is done, no reaction is observed. In the triaxial test, results under 2,000 psi hydrostatic pressure confirm that a preserved sample presents just a small reaction on the surface when in contact with de-ionized water, the reaction being due to the plug having been prepared by mechanically cutting it from a 4 in. diameter core.

In one embodiment, the method of the present invention comprises the following steps:

Collection of samples: In order to obtain preserved shales to conduct reactivity tests according to the concept of the present invention, the collection of shale cores is limited to the use of downhole rocks. Therefore the use of outcrop samples or reconstituted shale which do not represent the subsurface reactivity of the shale is condemned since such samples will present huge differences in behavior when compared to the native, downhole rock.

Preservation of cores: The cores must be preserved immersed in mineral oil at all times, from the moment they arrive at the rig floor. Immediately after removing the cores from the core barrel, remove the excess mud with paper or cloth and immerse them in leak-proof containers filled with an inert, organic solvent, such as kerosene or mineral oil. Mineral oil is the solvent of choice since it does not present fire hazard. The oil level must be above the core at all times.

Preparation of plugs for testing: This step is carried out with the aid of a coring machine as usually employed in the technique. The difference here is that the cutting of the test plug is effected with the core immersed in mineral oil so as to avoid dehydration of the plug to be tested. The plugs should be cut from the inner part of the core, to avoid the outer layer that has already been in contact with the drilling fluid. So, to avoid exposure to air during the coring operation, a coring box should be used, filled with mineral oil, and the core placed inside the box with the oil level above the rock. As the coring machine in general provides samples which are too big for the triaxial test machine, top and bottom faces should be adapted to the dimensions of the triaxial machine. Preparation of the top and bottom faces should be done just by cutting them with a saw, quickly. There is no need of a highly precise cut to prepare these faces. Note that any plug preparation that involves exposure to air for more than 5 minutes is not acceptable due to dehydration and consequently, altered results when measuring shale-fluid interaction in the triaxial test.

The preservation technique and handling procedure herein described and claimed to keep the original hydration of the core samples are the sole ways to measure the actual interaction of the test fluid with the shaly rock in a triaxial test which reproduces as closely as possible the same fluid-shale interaction under downhole conditions.

However, it should be noted that in spite of the above-described technique for the preservation of cores, there is observed an unavoidable loss in saturation due to the expansion associated with the stress relief and temperature change.

Mounting the test plug: In order to effect the reactivity test or triaxial test, the test plug (1) must be wrapped by a rubber sleeve (20) and a permeable sleeve (21) (see FIG. 1). The rubber sleeve (20) is made of a heat-sensitive, rubbery material which on gentle heating is made to closely conform to the plug dimension. The rubber sleeve (20) and the permeable sleeve (21) must be prepared in advance according to the length of the plug. The test plug (1) should be removed from the mineral oil, placed inside the sleeve (21) and rubber sleeve (20). After adjusting the heat-contracted rubber sleeve (2), while the top platen (7) and bottom platen (6) and metal spacers (3) and (3') are in place, the whole set should be placed on the base of the triaxial cell. At this point, mineral oil should be flown around the test plug. From the time the test plug (1) is removed from the mineral oil until the moment it is again surrounded by mineral oil, no more than 5 minutes should be elapsed. The remaining preparation can then be done with the guarantee that the test plug (1) is surrounded by mineral oil.

Reactivity test: The reactivity test makes use of the triaxial test which is effected in a test machine as described in U.S. Pat. No. 5,275,063. Computer and data acquisition system and servocontrolled hydraulic pressure systems are provided. Means to circulate mineral oil and test fluid through the test plug are equally provided. The computer control program is used to measure the axial and circumferential deformations undergone by the plug as a result from the applied confining pressures, as well as to control the confining and axial stresses. The final confining pressure to be attained in the test machine is the overburden pressure experienced by the shaly rock in the reservoir. The confining pressure should be increased in steps of from 500 to 1,000 psi. After each step the sample consolidation and pore pressure dissipation is accompanied by following the measured deformations recorded in graphs (see FIGS. 3 to 6).

Test plug consolidation is assumed to be complete when deformations are close to stability, that is, their variation is nearly nil. The confining pressure should be increased to a new step when the deformations reach an acceptable stabilization or equilibration as may be seen in the graphs. The excess pore-pressure generated by increasing the confining pressure is equilibrated by draining, allowing the consolidation of the plug. During the consolidation (equilibration) period, mineral oil should be periodically flown to assure the sleeve is not plugged.

The ensuing deformations evaluate the intensity of the test plug-fluid interaction. If after the consolidation period and contact with the test fluid the plug dimensions are not modified, that is, there are no observed deformations, this means that the fluid and the plug do not interact, or still, it can be said that there was no reaction between the plug and the fluid.

When the desired test pressure is attained, the test fluid can be flown, displacing the mineral oil which surrounds the plug. Normally the test pressure is the overburden pressure experienced by the rock in the formation. As stated before, the test fluid only should be pumped when the consolidation period is completed.

Although the pressure on the test fluid used in the experiments related herein is close to atmospheric, the method of the present invention further contemplates measuring the reactivity of the test plug under higher than atmospheric pressures. Thus, the test fluid may circulated around the plug under pressures of 100, 500 or even 1,000 psi. Such pressure creates a hydraulic potential on the test plug besides the chemical potential. The upper limit of the pressure to be used in the test fluid is linked to the effective pressure in the wellbore at which the drilling operations are carried out.

Also, whenever it is desired to reproduce the downhole temperature of a test plug, temperature may be applied to the,setup so as to asses the influence of temperature on the shale reactivity.

It should be noted that the method of U.S. Pat. No. 5,275,063 does not allow equilibration to be attained before the test fluid is flown. See FIG. 7C of this patent, which shows that water is contacted with the sample after a very short delay following the variation in confining pressure (FIG. 9A). FIG. 9C shows the test fluid being pumped before the sample reaches equilibrium. Non-stable deformations indicate that there was not enough time to attain equilibrium before test fluid was pumped. Besides, since the test plug is placed in the test machine and up to the contact with the test fluid it is left exposed to air, it is necessarily prone to dehydration. According to FIG. 9C the dehydration period may attain a few hours.

Therefore, three main, patentably distinguishing features are apparent as regards the present application: i) the need to equilibrate the sample before contact with the test fluid; ii) the preservation of downhole hydration up to the moment of contact with the test fluid; iii) the test of only one fluid on each sample under test.

Reactions of the test fluid and the plug of shaly rock are monitored via deformation measurements. The confining pressure is kept constant. The test fluid pressure is zero so that the effect of the chemical potential is isolated. The final plug dimensions can then be compared to the initial ones to check for expansion or compaction. For tests conducted with preserved samples according to the present invention no reaction was detected when samples were made to contact aqueous fluids such as de-ionized water, the sample dimensions having not been altered by the contact with water.

The test fluid contacting the plug should be collected to be analyzed as for the presence of minerals which could have been extracted from the test plug.

When cutting the plug to be tested in the triaxial test machine, the coring machine produces not only the plug to be tested in the triaxial test but also a residue which is the outer shell of the plug. The surface characteristics of the inner face of this outer shell are the same as those of the outer face of the plug to be tested. This is the basis of a sister test to be conducted with the outer shell of the core submitted to the same test fluid used for the plug in the triaxial test under laboratory conditions, that is, at ambient temperature and pressure. This sister test is a visual counterpart of the triaxial test. In the triaxial test the plug is invisible, while in the sister test visual observation is possible. The sister test provides important information for later interpretation of the reactions undergone by the same shale under pressure.

Measurements on the triaxial test machine are carried out on test plugs of shaly rock having 1 in., 1.5 in., or 2 in. diameter. The chosen diameter is a function of core availability. As the sample is not loaded until failure, there is no need to have a 2:1 ratio for the length/diameter, as required by the International Society of Rock Mechanics for strength tests. Therefore, short pieces of cores can be also used, increasing the number of tests to be conducted. Results are presented as radial and axial deformations as a function of time.

Figure 1:
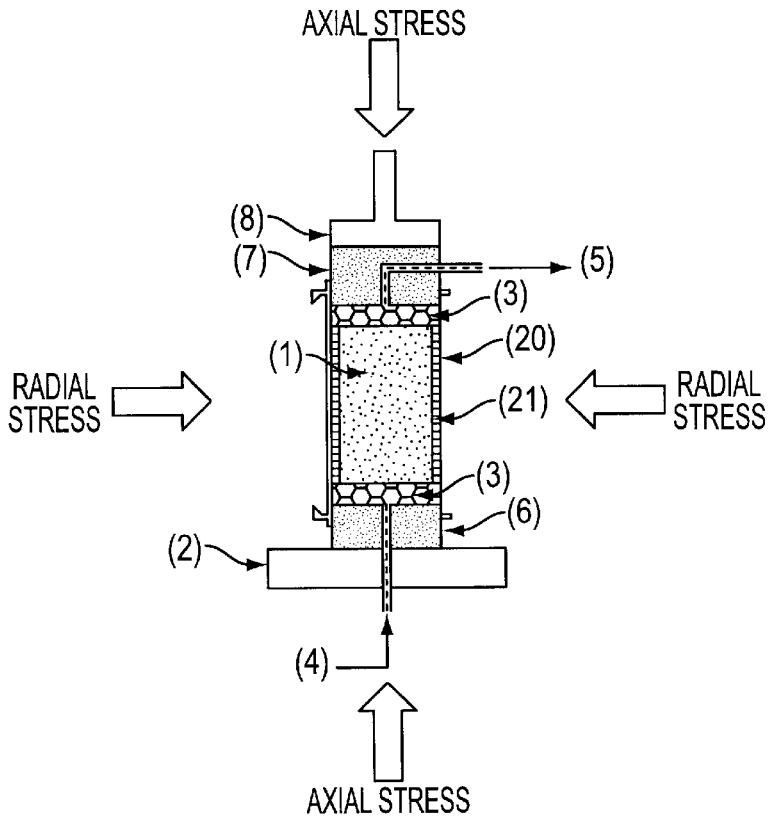

The test designed to the measurement of the shale reactivity when contacted with an aqueous fluid is better understood by reference to FIG. 1 attached, where: (1) is the test plug of shaly rock of which the reactivity is to be measured; (2) is the cell base on which is mounted the sample of shaly rock to be tested as for the reactivity with aqueous fluids; (3) is a metal spacer to avoid blockage of fluid flow on the bottom; (21) is a permeable sleeve designed to allow fluid to flow around the sample; (20) is a rubber sleeve designed to isolate the sample from the oil applying the confining pressure; (3') is a metal spacer designed to avoid blockage of fluid flow on the top (same function as (3)); (4) is a conduit for fluid inflow; (5) is a conduit for fluid outflow; (6) is a bottom platen where the sample rests; (7) is a top platen where the loading piston rests; (8) is the loading piston to apply the axial load.

During a reactivity test according to the present invention, the computer data acquisition and control program is used to apply the confining pressure and to record all the deformations. Axial load, confining pressure, axial strain and transverse strains are measured by the computer data program. Reaction of the sample with the test fluid will be monitored by the recorded deformations. In order to measure reactivity, it is preferred to run the test under constant confining pressure. For each sample under test only one fluid will be tested. This is because what is being sought is the in situ rock reactivity with that particular fluid. Therefore there is no meaning in testing successively various fluids on the same sample. As stated before, this is another distinctive point between the method of the present invention and the established technique as taught on col. 5 line 40 of U.S. Pat. No. 5,275,063 which allows several fluids to be run in sequence on one core.

In view of the description of the method of the present invention and the principles on which such method is based, it is easy to understand the drawbacks of the state-of-the-art technique, as set forth for example on column 2 of U.S. Pat. No. 5,275,063.

Thus, at line 20 of column 2 it is stated that "for samples having great affinity for the test fluid, the sample will try to absorb the test fluid. Such absorption causes the sample to swell in both the axial and radial directions". The absorption and swelling are actually a consequence of the dehydration undergone by the sample in the test machine. The swelling does not ensue as a result of affinity but rather as a result of poorly preserved sample. It can be said that all samples tested according to the method of U.S. Pat. No. 5,275,063 will necessarily experience an artificial swelling when contacted with water as a consequence of the dehydration of the sample which has been exposed to air for several hours before contacting the test fluid.

Thus it becomes clear why on line 25 of column 2 it is stated that "in one embodiment of the present invention triaxial swelling tests . . . . " The fact that the test is a swelling test means that the sample will necessarily swell for the reasons explained hereinbefore, that is, the swelling is a consequence of the erroneous way to perform the test, since during the preparation for the test, the sample will be exposed to air, and accordingly it will dehydrate. Note that the method described and claimed in the present invention limits the exposure period to air to not more than 5 minutes. Once dehydrated, the test sample will necessarily swell when in contact with an aqueous test fluid, no matter which aqueous fluid. This means that the sample will swell not because of its intrinsic nature or trend, but only because of the dehydration undergone in the sample preparation, outside and inside the test machine. Would the sample be truly preserved, it would not dehydrate and consequently would not swell.

Therefore the expression "preserved shale cores" on line 26 of col 2 indicates rather that the shale cores have been preserved up to the moment of the preparation for the triaxial test. From then on, the cores begin to dehydrate. So the test samples described by Steiger in U.S. Pat. No. 5,275,063 are not truly preserved samples, at least not in the sense used by the Applicant in the present application.

Then, on line 31 of same column 2 it is stated that multistage tests of multiple fluids on a core may be run. This is highly objectionable since the results will not accurately reflect the interaction of a shale with a particular fluid, but rather, the interaction (or reaction) of the core or rock which has already reacted with a previous fluid.

The triaxial strength test which measures the effects of hydration on the sample properties leads to erroneous conclusions since the measured effects of hydration are a consequence of the poor preservation during the test preparation. The sample upon exposure to air for hours necessarily dehydrates and then when contacted with an aqueous fluid will necessarily lose strength and fail when submitted to stress.

The present invention will be now illustrated by the following Examples, which should not be construed as limiting same.

EXAMPLE 1

Figure 2:
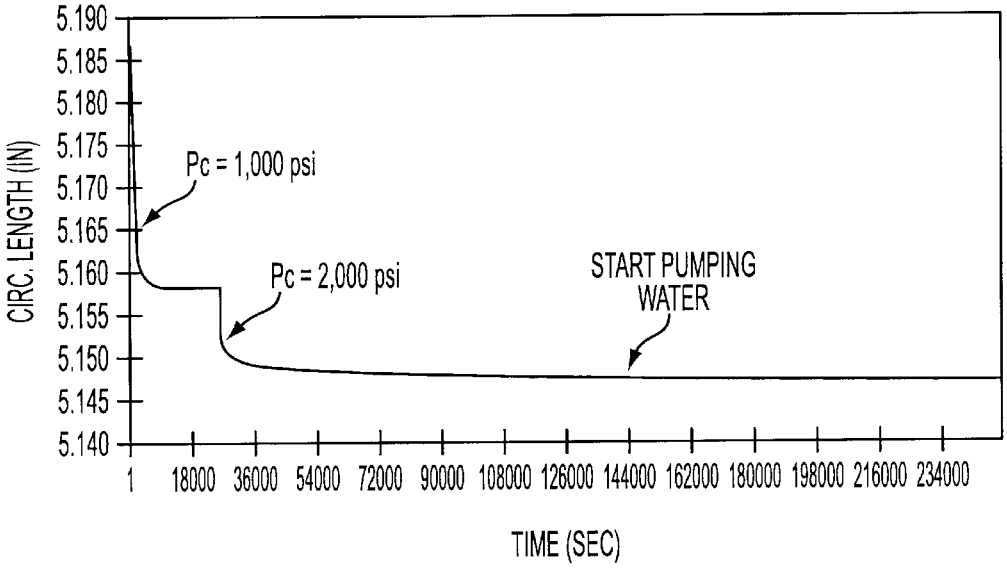

This is a control Example, carried out on a standard aluminum sample. A test sample made of aluminum instead of rock is used, having the dimensions of a test plug of shale sample. As the aluminum is inert to the test fluids, this Example aims at measuring all system deformations and verify the performance of the permeable sleeve and the rubber sleeve under the proposed procedure. The test was carried out in exactly the same way as with a plug of shaly rock in a test setup as illustrated in FIG. 1. As expected, when de-ionized water is flowed around the aluminum sample, displacing the mineral oil, no reaction occurs. The permeable sleeve and rubber sleeve deformation as a function of confining pressure and time were also recorded. Only the radial deformations are presented herein. FIG. 2 shows the plot of circumferential length as a function of time. Deformation is quickly stabilized after each increase in confining pressure, because the aluminum sample has no porosity. Therefore, no excess pore pressure is generated, leading to a zero consolidation time. According to FIG. 2, no deformations are observed when water is pumped. The confining pressure step adopted was 1,000 psi.

EXAMPLE 2

Figure 3:
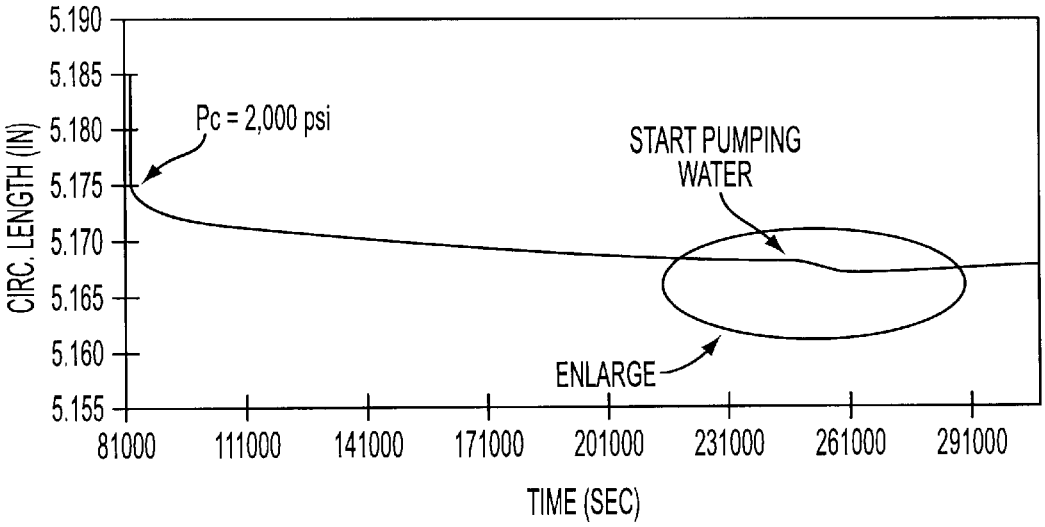
FIG. 3 is a graph of the circumferential length variation for an air-dried test plug of shale prepared for testing according to state-of-the-art techniques. The reaction of the shale after being contacted by water may be clearly seen.
Figure 4:
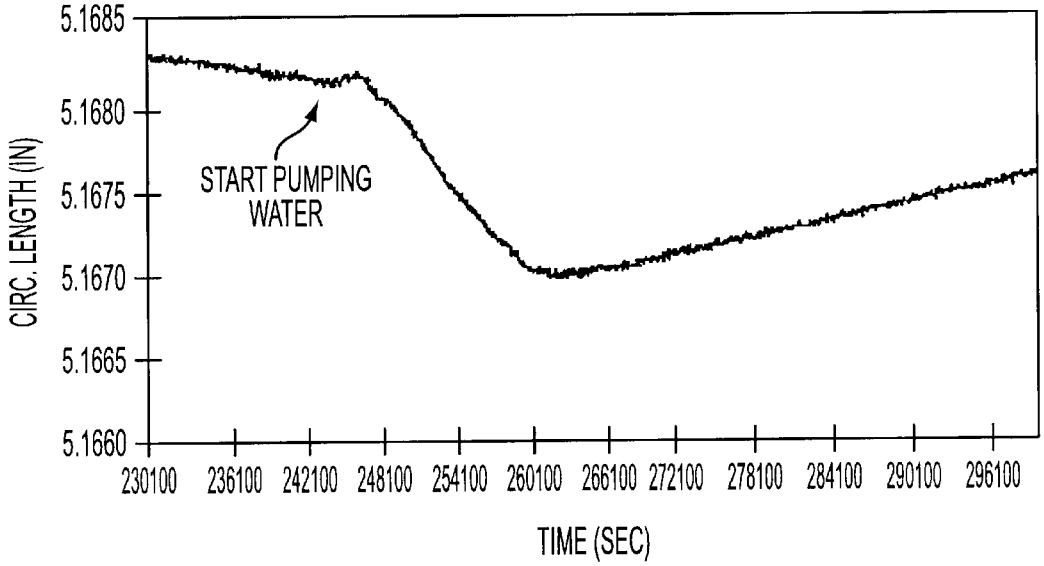
FIG. 4 shows an expanded time scale of FIG. 3, showing that the test plug started to expand but then contracted. After a contraction period it started to expand again.

This is another control Example, which reflects the situation of a test plug of shale sample prepared for test according to the state-of-the-art technique, that is, the sample is partially dried before testing. The test plug was prepared from a North Sea reddish shale which presented a strong reaction when immersed in de-ionized water under atmospheric pressure as well as under pressure. FIG. 3 illustrates the behavior of this sample under pressure. As soon as the test plug is made to contact water, displacing the mineral oil, the deformation rate starts to change: initially the sample shrinks, and after some time it starts to expand. As can be seen in FIG. 4, at first the test plug expands due to the swelling pressures generated. However, as the reaction with water proceeds, the shaly rock being tested weakens. This weakening or loss of strength under confining pressure leads to a new consolidation of the sample, causing further shrinkage. The swelling mechanisms are not sufficient to overcome the contraction. Only after more than 3 hours consolidation will the sample start to expand. FIG. 4 depicts an enlarged time scale for the deformations observed for the same dried shale.

EXAMPLE 3

This Example aims at presenting strong evidence that the principles of the present invention represent a true picture of the reaction of shales and fluids under a downhole condition.

FIGS. 5 and 6 appended fully illustrate these principles since they depict experiments carried out on test plugs from the same shaly sample, prepared for the reactivity test according to the principles of the present invention in one experiment (FIG. 5) and according to state-of-the-art techniques in another experiment (FIG. 6).

FIG. 5 is a graph of the deformations undergone by a truly preserved shale sample according to the concept of the present invention. A plug of such a sample when submitted to the action of water did not show any variation in dimensions. This is possible only because up to the moment where the water contacts the sample, it is preserved from the contact with air by the layer of mineral oil surrounding the sample. The absence of reaction of a shaly sample with water is unknown in the state-of-the-art technique since the current methods of sample preservation do not succeed in keeping the sample free from dehydration. That is why the mineral oil which surrounds the sample at all times keeping it from dehydration is an important part of the concept of the present invention. The sample preservation is thus a patentably distinguishing feature of the present invention, not anticipated nor suggested by previous documents.

FIG. 6 is a graph of the deformations undergone by a plug of an air-dried, non-preserved sample from the same shale sample contacted with the same fluid as that of FIG. 5. It is clearly seen that the sample dimensions have been altered by contact with the fluid (water). It should be pointed out that up to the moment of contact with water the sample was surrounded by oil in exactly the same way as in FIG. 5. However, as the sample had been exposed to air during 8 hours before the test, it was dehydrated and reacted when exposed to water. This test leads to the conclusion that mineral oil does not hinder the rock-fluid reaction in case the sample is partially dehydrated.

A series of relatively simple experiments on water redistribution within a shaly sample lead to interesting conclusions regarding the cause of the difference in reactivity observed in immersion tests.

Thus, three samples from adjacent pieces of a preserved core were air dried for 2 hours in the same environment. After the 2-hour period, sample A was immersed in de-ionized water and the remaining two samples were immersed in mineral oil to avoid anymore dryness and allow any water redistribution. After 2 weeks in mineral oil sample B was immersed in de-ionized water, while sample C was immersed in de-ionized water after 4 weeks immersion in mineral oil. After the first air-drying period 1% of the total weight of the sample had been lost. The water content on the surface of the sample at different times for water redistribution evaluation is listed below, the contents being expressed in percentage:

TABLE

| Description | Free water | Bound water | Crystalline water |
|---|---|---|---|
| Original water content | 7.08 | 0.81 | 17.88 |
| After 2 hours drying on air | 4.21 | 1.01 | 18.50 |
| After 2 weeks immersed in oil | 6.70 | 2.16 | 18.25 |
| After 4 weeks immersed in oil | 6.11 | 1.21 | 18.15 |

The Table above shows that not only free water but also bound water contents change. The difference in free water after 2 and 4 weeks in mineral oil might indicate that a complete equilibrium had not yet been achieved. Even after 4 weeks some water is still moving. Significant differences in bound water are observed. Although not bound to a specific theory, the Applicant hypothesizes that shale dryness by losing water at room temperature is not a reversible process.

Experiments on water redistribution seem to show that the larger the difference in water content from the original value, the stronger the reaction. Without any redistribution, surface reaction is intense (Sample A). After the outer layers react, the inner part of the sample remains intact. For sample B, surface reaction was not intense but after 46 hours the sample broke in three pieces. This means that as water redistributed, it moved from the inner part of the sample to equilibrate at the surface. Consequently, water content on the surface approached its original value while the inner portion was dried, creating a more homogeneous water distribution so that reaction occurs throughout the sample, rather than just on the surface. In Sample C a more homogeneous water distribution throughout the sample resulted from the longer immersion in mineral oil.

Therefore these experiments may indicate that water in the shale is the key parameter which controls its reactivity.

Finally, it is of interest to draw the attention to a few facts which underline the state-of-the-art technique as compared to the principles which led to the findings of the present invention:

Sample Preservation

The concept of sample preservation according to the state-of-the-art comprises keeping the test plug of shaly rock preserved from dehydration by immersion in a hydrocarbon solvent, for example, or paraffin wax, up to the moment of sample preparation. From then on, the sample is left exposed to air. As the procedure involved in the preparation for example of a triaxial test involves lengthy steps which may take more than a couple of hours, while the test itself involves equilibration steps which in turn take several hours, it is easily understood the extent of dehydration undergone by the sample during the whole test procedure. So, according to the technique set forth in documents such as SPE paper 18024 and U.S. Pat. No. 5,275,063, the care in maintaining the sample isolated from air in order to avoid dehydration is limited to the period which precedes the preparation of the sample for test while during the triaxial test which is the main tool for evaluating shale-fluid interaction the sample is exposed to air for several hours, this implying in severe dehydration of the shale sample and therefore inaccurate results.

Swelling Pressure Test

As taught in the state-of-the-art publications, the swelling pressure test procedure involves confining pressure measurements under constant volume. During the test, axial and radial strain is measured. Drainage of pore water is allowed but equilibration of the pore pressure is not allowed. So, not enough time is given for the sample to equilibrate the excess pore pressure. Therefore, the increase in confining pressure recorded during the test is not solely due to the rock-fluid interaction, but has a huge component of consolidation. In this way, the recorded change in confining pressure has been mistakenly attributed to the interaction with the fluid. Additionally, as taught by the state-of-the-art technique, only the resultant of the axial and radial confining pressure should be measured, even though the machine records individually the axial and radial deformation. Since clay-rich rocks are highly anisotropic, this procedure leads to severe loss of information which is essential to fully interpret the results.

Contrary to these teachings, the present application is based on the principle that reactivity measurements in the triaxial test machine should be effected at constant pressure. According to the concept of the present invention, the triaxial test is designed for determining reactivity of a plug of shaly sample and not its failure. In the method of the Applicant, measurements provide the circumferential and axial length variation of the sample as a result of the interaction of the sample with the test fluid. Also, during all the equilibration period, since mineral oil is kept circulating around the test plug, it is kept isolated from air and dehydration is avoided. This approach is completely absent from the available descriptions of the open literature. It is only when the test plug has been equilibrated that the test fluid is made to contact the shaly sample. This contact therefore very closely represents the downhole situation, since the pressure attained by the test plug has been raised to the overburden pressure of the wellbore and the sample is preserved from air as it is in its undisturbed, downhole condition. For sure during preparation of the test plug for testing a quick contact (not more than 5 minutes) of the sample with air is possible, however the ensuing dehydration is nearly negligible. That is why the results obtained through the method herein described and claimed represent the best approach to reproduce shale-fluid interaction under actual downhole conditions.

Successive Testing of Different Fluids

It should also be noted that the practice of flowing different fluids around the shaly sample is erroneous since each fluid produces a particular reaction on the rock. Therefore, after the rock has already contacted a fluid, the next fluid will measure the reactivity of the altered rock, not of the original rock anymore. This is a serious issue because it can lead to erroneous interpretation of the actual rock to be drilled downhole.

Finally, the Applicant believes that in spite of the huge efforts and high expenditure involved in the published results from different researches concerning this sensible area, there is a fundamental bias in the approach used, which consists mainly in allowing the sample to dehydrate in the triaxial test machine for several hours, before the sample contacts the test fluid, this leading to inaccuracies as regards the interpretation of results.

Further, the state-of-the-art technique generally tries to measure chemical potential and hydraulic potential at the same time. Both influences can be measured, but only after each influence has been completely understood. That is why in the examples presented by the Applicant the only potential being applied is the chemical one. Also, the hydraulic and thermal potentials may be evaluated, one at a time, to isolate the effects and so to make sure that the consequences are fully understood.

So, test results presented by the Applicant are an evidence of the mistaken steps suggested by service companies and used by oil companies when employing inhibitive fluids in order to stop swelling. It seems clear that, if swelling occurs downhole, it should be attributed to other reasons than shale-fluid interaction.

The reactivity test herein described and claimed is therefore an evidence that truly preserved shales do not actually react with a fluid such as water, and that the observed well-bore instablity problems during drilling operations should be attributed to other causes than fluid-shale interaction:

What is claimed is:

1. A method for the evaluation of shale reactivity under constant pressure for a preserved shale sample collected from a formation reservoir, where the method attempts to replicate a set of downhole conditions experienced by said shale sample under either an equilibrium state or non-equilibrium state including extreme conditions as subjected to during duplicating a drilling operation done at an overbalance pressure, which comprises the steps of:

collecting a set of downhole shale cores and preparing a corresponding set of test plugs for testing under conditions that model a state of original downhole hydration, such that a variable pore pressure across said shale cores can be controlled, adjusted or maintained by a pore pressure system;

under the same conditions of original downhole hydration as maintained by application of a preserving mineral oil, introducing a test plug in a triaxial test machine for conducting a triaxial test via a pressurized test fluid and raising confining pressure in both axial and radial directions by increments of from 500 to 1,000 psi, while allowing a quiescent time period for equilibrating the sample after each increment in pressure, the pressure being raised up to the overburden pressure experienced by the collected shale in the reservoir;

by draining, allowing the pore pressure to equilibrate between each increment in confining pressure, while still preserving conditions of original downhole hydration by circulating a preserving mineral oil through the pore pressure system, the equilibrium state being monitored by a triaxial detector apparatus sensitive to both radial and vertical strains;

after equilibrium is attained, introducing the test fluid in the pore-pressure system to initiate a physical or chemical interaction with said shale sample so as to evaluate reactivity of the test plug of shale sample to said fluid by means of the interaction of the test fluid and the test plug while the test fluid displaces the mineral oil from the surface of the test plug, and monitoring said interaction of test plug and test fluid by means of performing and comparing a series of deformation measurements done on said shale sample subject to any of a set of different conditions including a temperature or thermal potential, a hydraulic potential and/or a chemical potential.

2. A method according to claim 1, wherein the test plug is prepared in a coring machine under conditions which preserve the original downhole hydration.

3. A method according to claim 1, wherein throughout the test, the temperature of any fluids which contact the test plug is kept constant.

4. A method according to claim 3, wherein said temperature is set at a temperature in the range of from the ambient temperature up to the downhole temperature.

5. A method according to claim 1, wherein the pressure of any fluid which contacts the test plug is constant.

6. A method according to claim 4, wherein the pressure of the test fluid varies of from atmospheric and up to the overbalance pressure used during the drilling operation.

7. A method according to claim 1 wherein when preparing the test plug by cutting the downhole shale core, the outer shell of the core is separated and immersed, at ambient temperature and atmospheric pressure, in the same test fluid as that one used in the triaxial test machine so as constitute a visible counterpart or sister test of the events in the triaxial test machine.

8. A method according to claim 1 wherein the deformation measurements comprise both of separately measured axial and radial deformations of the test plug submitted to confining pressure.

9. A method according to claim 1, wherein after having contacted the test plug the test fluid is collected in order to be analyzed as for chemical content and mineral composition.

10. A method according to claim 1, wherein only one single test fluid is tested on each test plug.

* * * * *